US008221053B2

(12) United States Patent
Predmore et al.

(10) Patent No.: US 8,221,053 B2
(45) Date of Patent: Jul. 17, 2012

(54) SHAPED AND STIFFENED LOWER EXHAUST HOOD SIDEWALLS

(75) Inventors: Daniel R. Predmore, Ballston Lake, NY (US); Edward J. Sharrow, Scotia, NY (US); Kumar Navjot, Jamshedpur (IN)

(73) Assignee: General Electric Company, Schenectady, NY (US)

( * ) Notice: Subject to any disclaimer, the term of this patent is extended or adjusted under 35 U.S.C. 154(b) by 696 days.

(21) Appl. No.: 12/473,777

(22) Filed: May 28, 2009

(65) Prior Publication Data

US 2010/0303619 A1 Dec. 2, 2010

(51) Int. Cl.
*F01D 25/26* (2006.01)

(52) U.S. Cl. ..... 415/108; 415/214.1; 415/220

(58) Field of Classification Search ..... 415/213.1, 415/214.1, 220, 108
See application file for complete search history.

(56) References Cited

U.S. PATENT DOCUMENTS

| | | | | |
|---|---|---|---|---|
| 3,630,635 | A * | 12/1971 | Fatum | 415/214.1 |
| 4,013,378 | A | 3/1977 | Herzog | |
| 4,326,832 | A * | 4/1982 | Ikeda et al. | 415/213.1 |
| 5,167,123 | A | 12/1992 | Brandon | |
| 5,375,547 | A | 12/1994 | Abe et al. | |
| 5,495,714 | A * | 3/1996 | Gros et al. | 60/687 |
| 6,419,448 | B1 * | 7/2002 | Owczarek | 415/207 |
| 6,484,503 | B1 | 11/2002 | Raz | |
| 6,971,842 | B2 | 12/2005 | Luniewski et al. | |
| 2007/0081892 | A1 | 4/2007 | Sharrow | |

* cited by examiner

*Primary Examiner* — Ninh H Nguyen
(74) *Attorney, Agent, or Firm* — Ernest G. Cusick; Frank A. Landgraff

(57) ABSTRACT

An arrangement and method adapted for providing a stiffened lower exhaust hood for a steam turbine. Sidewalls of the lower exhaust hood may taper inward between a horizontal joint and an inlet to a condenser for the steam turbine, providing an enhanced flow path for the exhaust steam. Stiffening of the sidewalls may be provided by stiffening bends, stiffening curvature, and external stiffening beams on the wall plate of the sidewalls of the lower exhaust hood, permitting reduction or elimination of structural supports within the exhaust hood, which degrade exhaust steam flow.

20 Claims, 6 Drawing Sheets

SHAPED AND STIFFENED LOWER EXHAUST HOOD SIDEWALLS

BACKGROUND OF THE INVENTION

The invention relates generally to steam turbines and more specifically to lower exhaust hoods for the steam turbines.

The outer shell of a steam turbine low-pressure section is generally called the exhaust hood. The primary function of an exhaust hood is to divert the steam from the last stage bucket of an inner shell to the condenser with minimal pressure loss. Usually the lower half of the exhaust hood supports an inner casing and acts as the supporting structure for the rotor. The upper exhaust hood is usually a cover to guide the steam to the lower half of the hood. The hood for large double flow low-pressure steam turbines are of substantial dimensions and weight and usually are assembled only in the field. In many steam turbines, the inner case of the steam turbine, for example a double flow down exhaust unit has an encompassing exhaust hood split vertically and extending along opposite sides and ends of the turbine. This large, box-like structure houses the entire low-pressure section of the turbine. The exhaust steam outlet from the turbine is generally conically-shaped and the steam exhaust is redirected from a generally axial extending flow direction to a flow direction 90 degrees relative to the axial flow direction. This 90-degree flow direction may be in any plane, downwardly, upwardly or transversely. Thus the prior exhaust hoods for steam turbines constitute a large rectilinear structure at the exit end of the conical section for turning and diffusing the steam flow at right angles.

The lower half of the exhaust hood, split vertically from the upper half, directs the exhaust flow of steam to a condenser usually located generally beneath the exhaust hood. The lower exhaust hood typically supports the inner casing of the turbine and the associated steam path parts such as diaphragms and the like. The lower exhaust hood is further loaded by an external pressure gradient between atmospheric pressure on the outside and near-vacuum conditions internally. The lower exhaust hood shell is generally of fabricated construction with carbon-steel plates. Typical sidewalls for the lower exhaust hood are flat and vertically oriented. To provide resistance to the inward deflection of the sidewalls under vacuum loading, the lower exhaust hood traditionally has included internal transverse and longitudinal plates and struts. These internal transverse and longitudinal plates and struts form a web, generally underneath the turbine casing and extending to the sidewalls. Vertical sidewalls result in a stagnant flow region underneath the inner casing. Flat walled hoods require flow plates. Flow plates are used to prevent the rapid expansion of the exhaust steam after passing through a horizontal joint restriction between the inner casing and the exhaust hood.

The internal hood stiffeners and flow plates are costly. Further, the thick-walled plate used for the sidewalls is also costly. Prior attempts to stiffen exhaust hoods have focused on different combinations of internal stiffeners (pipe struts, plates) and wall thicknesses.

FIG. 1 illustrates typical arrangements of a low-pressure turbine 100 with an exhaust hood. An exhaust hood 10 includes an upper exhaust hood 15 and a lower exhaust hood 20, mating at a horizontal joint 22. An inner casing 25 is supported at multiple supporting pads 30 on the lower exhaust hood 20. To distribute the load from these pads to a foundation (FIG. 2) for the low-pressure turbine, various supporting structures are present in the form of transverse plates 35, beams 37 and struts 40. These transverse plates 35 avoid the suction effect of the sidewalls 45 and end walls 50 and they distribute the load applied on the hood due to loads on inner casing 25. The lower exhaust hood 20 may further provide a support location 55 for shaft seals (not shown) and end bearings (not shown) for the turbine rotor (not shown). The lower exhaust hood may include a framework 70 including support ledge 75 that may rest on the external foundation (FIG. 2).

The sidewalls 45 and end walls 50 may be constructed of flat metal plates 60 (FIG. 1), joined at seams by welding or other known joining methods. Because of the similarity of construction and function, both sidewalls and end walls may hereafter be referred to as "sidewalls". The foundation may be comprised of concrete with an opening, including vertical walls, and sized to accommodate the lower exhaust hood with its vertical sidewalls within.

FIG. 2 illustrates an axial view of a typical exhaust hood for a steam turbine illustrating flat sidewalls and a restricted steam flow path. The exhaust steam flow 65 in the upper exhaust hood 15 must pass by the horizontal joint restriction 80 between the hood 10 and the inner casing 25 before reaching a rectangular chute region 95 that conveys the steam downward to the condenser opening 85 at the bottom of the lower exhaust hood 20. The condenser opening 85 is much larger than the horizontal joint restriction 80, resulting in a stagnant zone 97 underneath the inner casing 25. To avoid uncontrolled expansion downstream of the horizontal joint restriction 80, flow plates 98 are added. To control deflections of the chute region 95 due to the inward-acting pressure gradient, the transverse support plates 35 provide internal stiffening.

The problem previously has been addressed by putting transverse and stiffening plates through out the hood. The methodology heretofore followed has been to make hood stiff enough by adding material so as to avoid excess deflection. The problem is that to control the side and end wall deflections of the hood, transverse and stiffeners are required inside of the hood. The existence of these transverse and struts increases the complexity of the hood, increases the weight of the hood and creates aero blockages resulting in aero performance losses.

Accordingly, it may be desirable to provide an alternate hood structure that reduces cost, complexity and improves flow distribution.

BRIEF DESCRIPTION OF THE INVENTION

The present invention relates to an arrangement and method for providing a stiffened lower exhaust hood for a steam turbine. Stiffening may be provided by stiffening bends, stiffening curvature, and external stiffening beams on the wall plate of the sidewalls of the lower exhaust hood.

Briefly in accordance with one aspect of the present invention, a steam turbine exhaust hood is provided. The steam turbine exhaust hood includes a lower exhaust hood joined at a horizontal joint with an upper exhaust hood section. A chute section is provided within the lower exhaust hood. Opposing sidewalls on the chute section include an inward taper below the horizontal joint. The opposing sidewalls include stiffening means.

According to a further aspect of the present invention, a method is provided for stiffening sidewalls of a lower exhaust hood of a steam turbine exhaust hood. The method includes tapering the sidewalls inward on a chute section below a horizontal joint of the lower hood and providing a stiffening means on the opposing sidewalls

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

Figure 1:
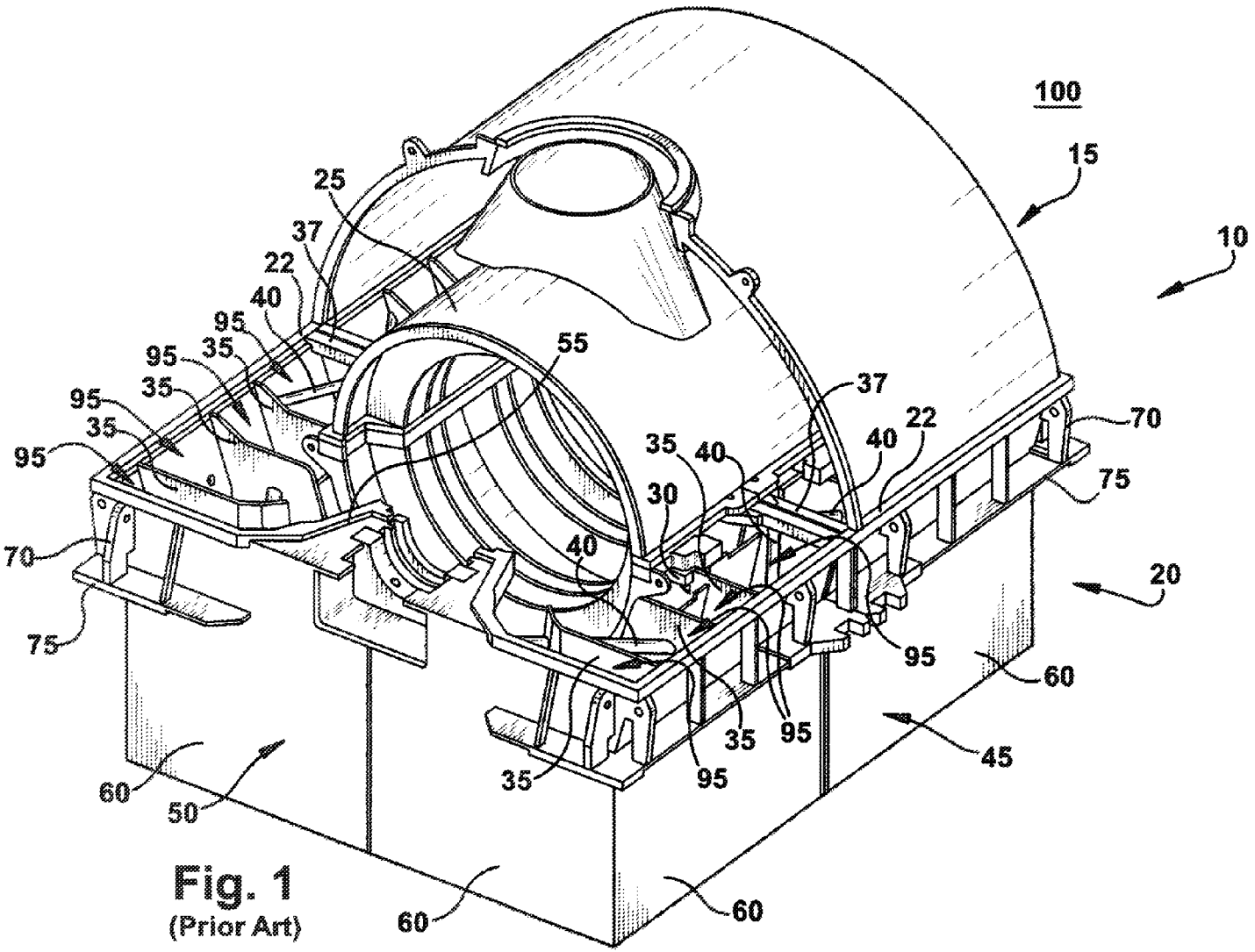
Fig. 1 (Prior Art)
FIG. 1 illustrates typical arrangements of a low-pressure turbine with an exhaust hood.
Figure 2:
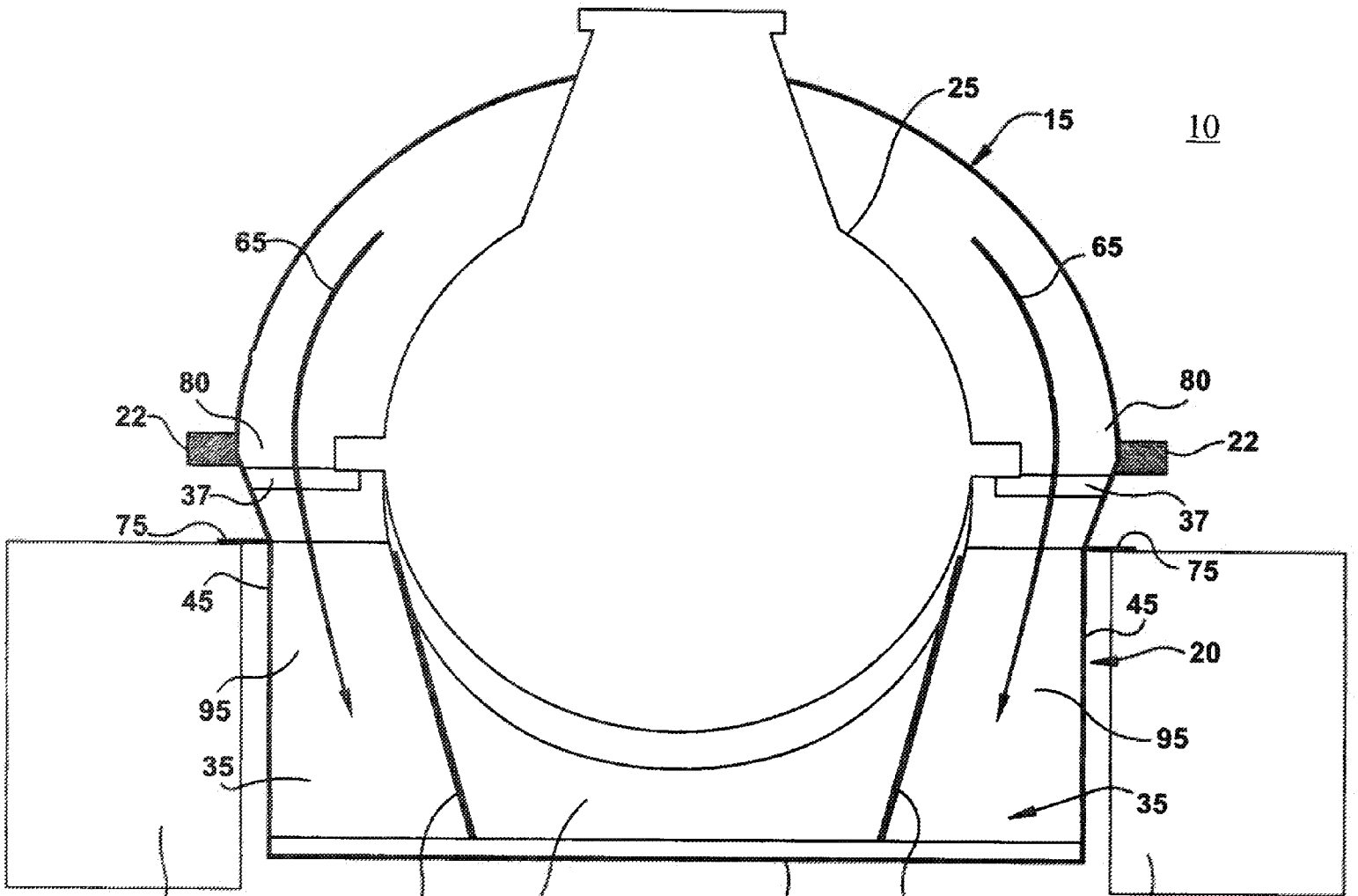
Fig. 2 (Prior Art)
FIG. 2 illustrates an axial view of a typical exhaust hood for steam turbine illustrating flat sidewalls and a limited steam flow path.

The following embodiments of the present invention have many advantages, including improving both the stiffening of the sidewalls of the lower exhaust hood and the flow distribution in the chute region of the lower exhaust hood. Improved sidewall stiffening is achieved via bends, curvature and external support beams in the sidewall, used alone or in combination. Flow distribution is improved via the inward (non-vertical) orientation of the sidewalls to direct exhaust flow underneath the inner casing, making use of the formerly stagnant region.

In the present invention, means for stiffening the large-expanse, flat sidewall(s) are provided. Stiffening means may include any combination of bends, curvature and beams in the opposing sidewalls, thereby reducing or eliminating the need for internal stiffeners such as plates and pipe struts. With improved sidewall stiffening, thinner plate for the sidewall can also be considered. Further, the sidewalls are inward-oriented so as to push exhaust steam flow towards the center, increasing usage of the stagnant region underneath the inner casing thereby reducing or eliminating the need for internal flow plates.

Any combination of bends, curvature and beams in sidewall(s) may reduce or eliminate the need for internal stiffeners and thick walls, reducing hood cost. Removal of internal stiffeners also reduces flow blockage, improving aerodynamic performance. The sidewalls are oriented to manage steam expansion within the chute, also improving aerodynamic performance. Better flow management within the chute, to make better use of the stagnant region underneath the inner casing, reduces the need for costly flow plates. In addition, it allows a smaller condenser opening, reducing overall plant cost.

FIGS. 3-6, which follow, illustrate the large-expanse, sidewall(s) of the lower exhaust hood are stiffened by any combination of bends, curvature and external stiffening beams, reducing or eliminating the need for internal stiffeners such as plates and pipe struts. With improved sidewall stiffening, thinner plate can also be considered. FIGS. 3-6 further illustrate that the embodiments of inventive sidewalls are inward-oriented so as to push exhaust steam flow towards the center, increasing usage of the stagnant region underneath the inner casing thereby reducing or eliminating the need for internal flow plates. Like parts within FIGS. 2-6 will be indicated with common reference numerals.

Figure 3:
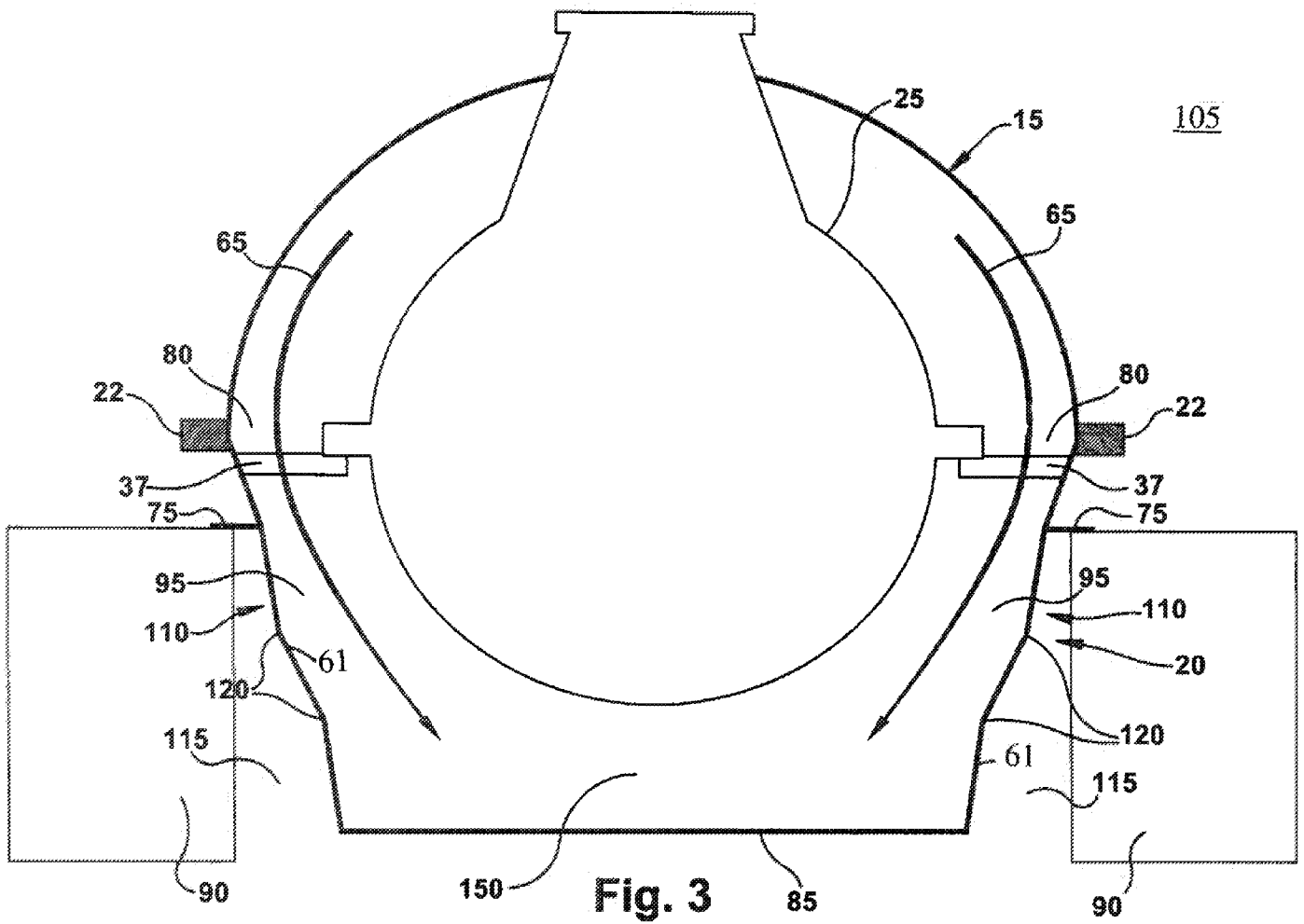
FIG. 3 illustrates an axial view of an embodiment of an inventive exhaust hood for a steam turbine incorporating inward tapering sidewalls with stiffening bends.

FIG. 3 illustrates an axial view of an embodiment of an inventive exhaust hood 105 for a steam turbine incorporating inward tapering sidewalls with stiffening bends. In the inventive arrangement, sidewalls 110 in the chute region 95 of the lower exhaust hood 20 taper inward toward the center of exhaust hood as the sidewalls 110 extend from support ledge 75. The inward taper of the sidewalls 110 form a space 115 between the sidewalls and the foundation 90. One or more stiffening bends 120 may be provided along the axial length of the plate 61 of the sidewall. The stiffening bends 120 of the plate 61 may be produced by known means. The stiffening bends 120 of the plates 61 of the sidewall 110 will stiffen the plate resistance to deformation from the differential pressure between outside atmosphere and vacuum within the lower exhaust hood 20. The stiffening bends 120 may reduce or eliminate the need for internal transverse stiffeners, resulting in improved usage of the underneath region 150 through reduced or eliminated flow plates.

Figure 4:
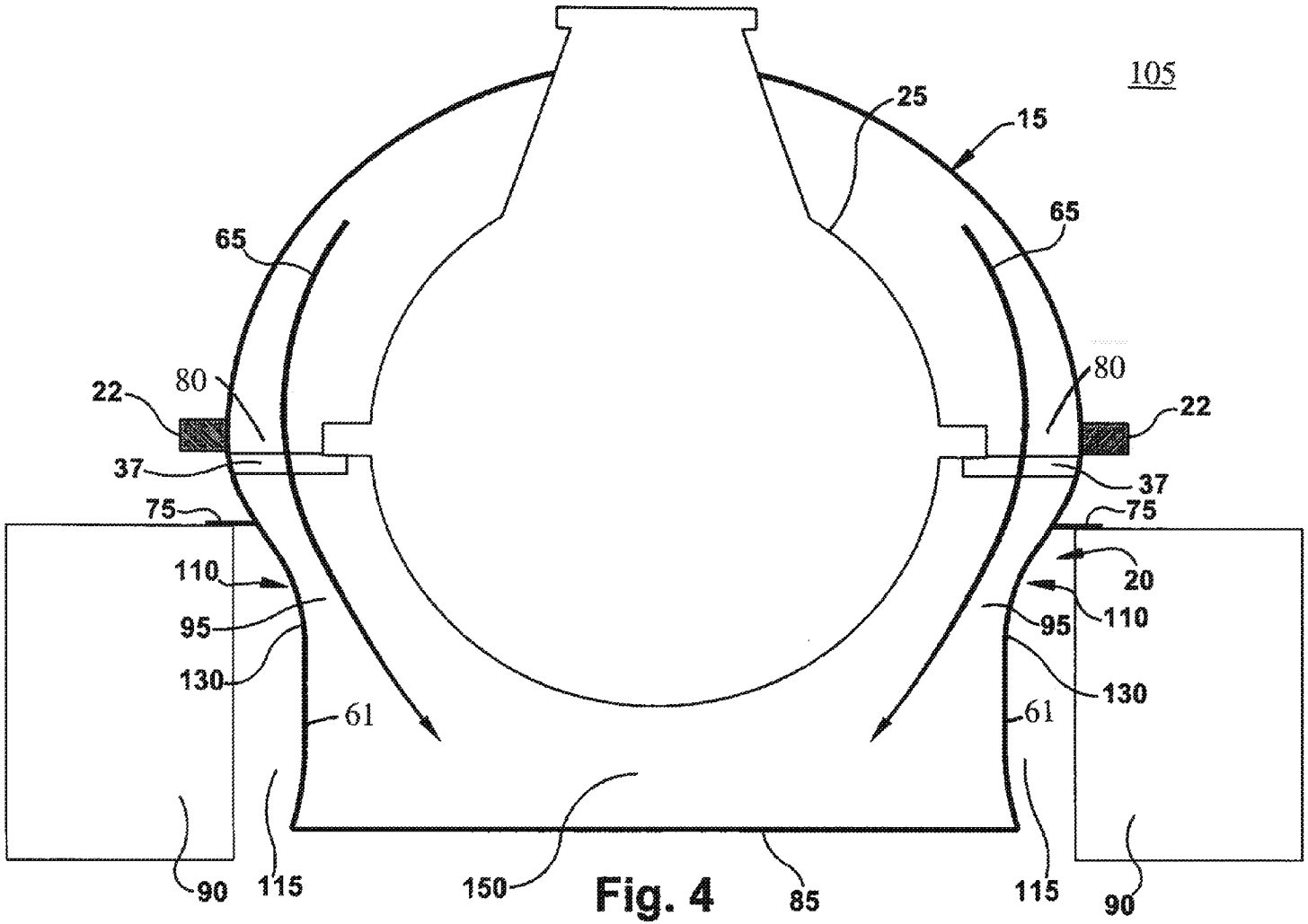
FIG. 4 illustrates an axial view of an embodiment of an inventive exhaust hood for a steam turbine incorporating inward tapering sidewalls with stiffening curvature on the lower exhaust hood.

FIG. 4 illustrates an axial view of an embodiment of an inventive exhaust hood 105 for a steam turbine incorporating inward tapering sidewalls with stiffening curvature on the lower exhaust hood. In the inventive arrangement, sidewalls 110 in the chute region 95 of the lower exhaust hood 20 taper inward toward the center of exhaust hood as the sidewalls 110 extend from support ledge 75. The inward taper of the sidewalls 110 form a space 115 between the sidewalls and the foundation 90. A stiffening curvature 130 may be provided axially along a length of the plate of the sidewall. The curvature may be simple or complex. The stiffening curvature 130 of the plate 61 may be produced by known means. The curvature of the plates 61 of the sidewall 110 will stiffen the plate resistance to deformation from the differential pressure between outside atmosphere and vacuum within the lower exhaust hood. The stiffening curvature 130 may reduce or eliminate the need for internal transverse stiffeners, resulting in improved usage of the underneath region 150 through reduced or eliminated flow plates.

Figure 5:
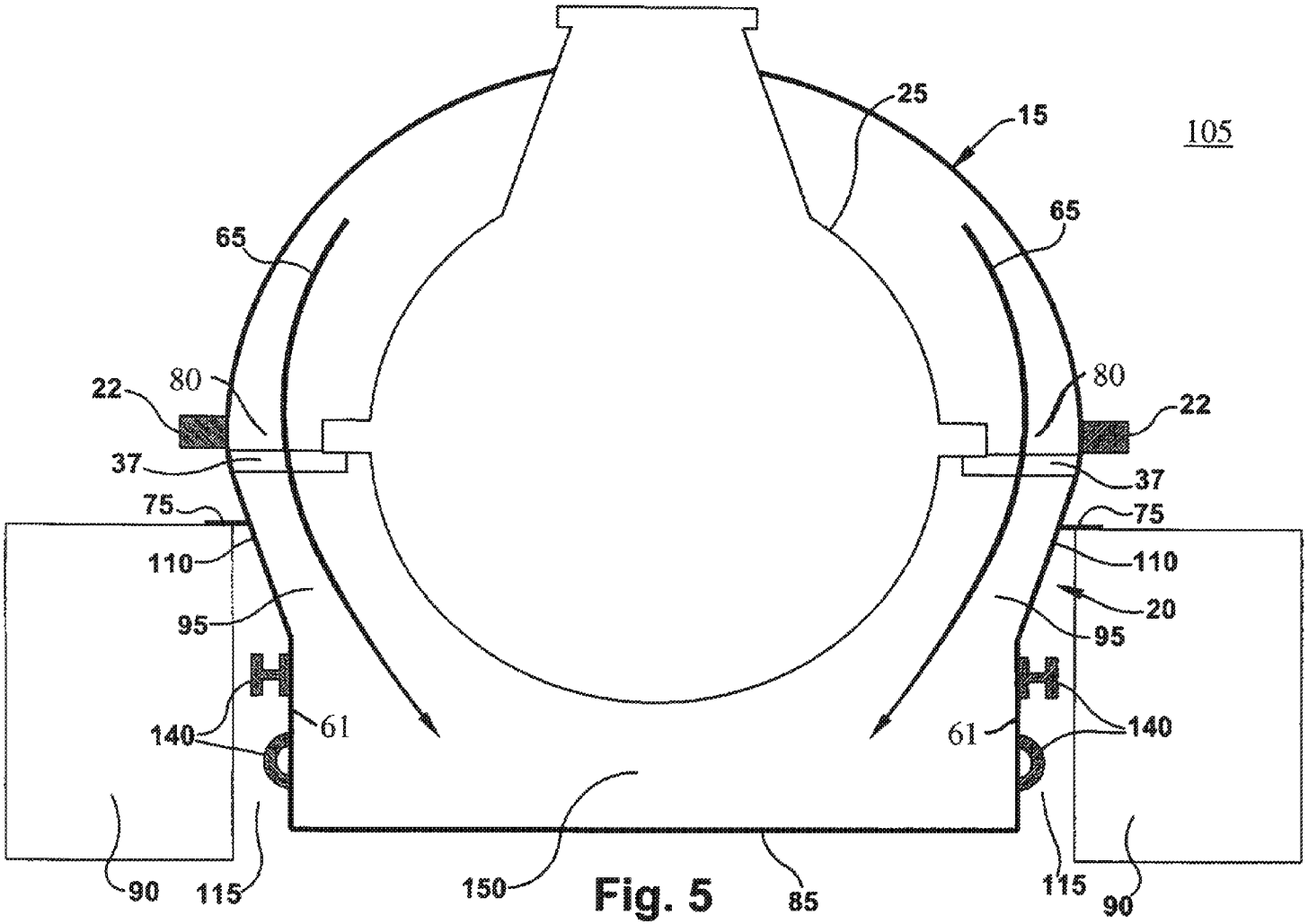
FIG. 5 illustrates an axial view illustrates of an embodiment of an inventive exhaust hood for a steam turbine incorporating inward tapering sidewalls with stiffening external beams on the lower exhaust hood.

FIG. 5 illustrates an axial view of an embodiment of an inventive exhaust hood 105 for a steam turbine incorporating inward tapering sidewalls with stiffening external beams on the lower exhaust hood. In the inventive arrangement, sidewalls 110 in the chute region 95 of the lower exhaust hood 20 taper inward toward the center of exhaust hood 105 as the sidewalls 110 extend from support ledge 75. The inward taper of the sidewalls 110 form a space 115 between the sidewalls and the foundation 90. One or more external stiffening beams 140 may be provided axially along a length of the plate 61 of the sidewall. The beams may be of known shapes and may be attached externally to the plate of the sidewall by known means. The external stiffening beams 140 on the sidewall will stiffen the plate resistance to deformation from the differential pressure between outside atmosphere and vacuum within the lower exhaust hood. The external stiffening beams 140 may reduce or eliminate the need for internal transverse stiffeners, resulting in improved usage of the underneath region 150 through reduced or eliminated flow plates.

Figure 6:
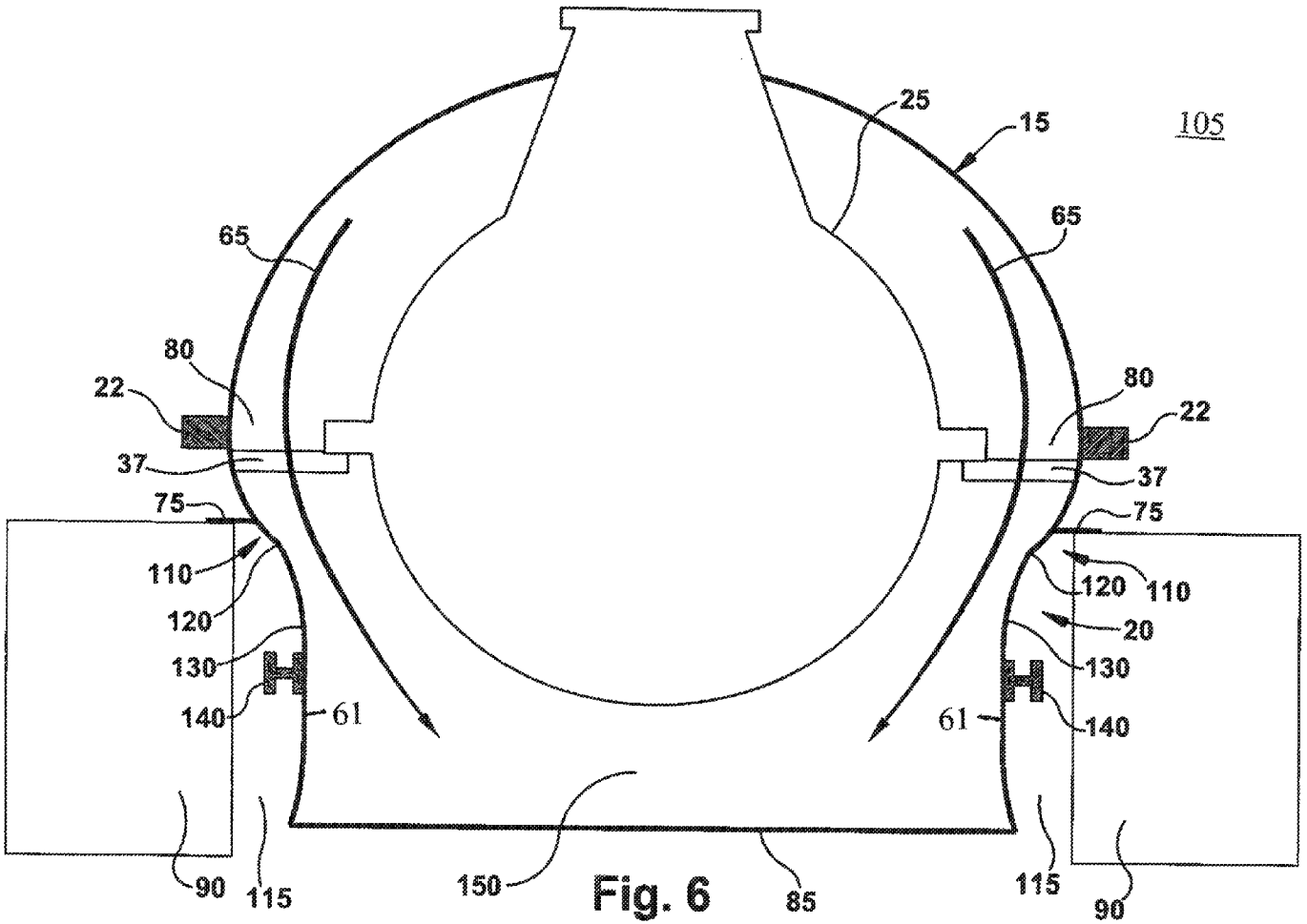
FIG. 6 illustrates an axial illustrates an an embodiment of an inventive exhaust hood for a steam turbine incorporating inward tapering sidewalls with a combination of stiffening bends, stiffening curvature and external stiffening beams on the lower exhaust hood.

FIG. 6 axial illustrates an axial view of an embodiment of an inventive exhaust hood 105 for a steam turbine incorporating inward tapering sidewalls 110 with a combination of stiffening bends 120, stiffening curvature 130 and external stiffening beams 140 on the lower exhaust hood 20.

In a further aspect of the present invention, a method is provided for stiffening sidewalls of a lower exhaust hood of a steam turbine exhaust hood. The method includes tapering the sidewalls inward on a chute section below a horizontal joint of the lower hood; and providing stiffening means on the opposing sidewalls. One embodiment of the method may further include forming at least one stiffening bend on the inward tapering sidewalls, stiffening bends being adapted to reduce or eliminate the use of internal transverse stiffeners. A second embodiment of the method may include forming at least one stiffening curvature on the inward tapering sidewalls, the stiffening curvature being adapted to reducing or eliminating the need for internal transverse stiffeners. The method for providing curvature of the sidewalls according may include providing a simple curvature or a complex curvature. A third embodiment of the method for stiffening sidewalls may include applying one or more external stiffening beam axially along the sidewalls, the stiffening beams adapted to reduce or eliminate the use of internal transverse stiffeners.

In further embodiments of the method for stiffening sidewalls, combinations of one or more of forming at least one stiffening bend on the inward tapering sidewalls; forming one or more stiffening curvatures on the inward tapering sidewalls; and one or more of applying external stiffening beams on the exterior of the inward tapering sidewalls may be employed. Herein, the combinations of forming the stiffening bends, forming the stiffening curvatures and applying the external stiffening beams are adapted to reduce or eliminate internal transverse stiffeners.

While various embodiments are described herein, it will be appreciated from the specification that various combinations of elements, variations or improvements therein may be made, and are within the scope of the invention.

The invention claimed is:

1. A steam turbine exhaust hood comprising:

a lower hood joined at a horizontal joint with an upper exhaust hood;

a chute section of the lower exhaust hood;

opposing sidewalls on the chute section, wherein the sidewalls taper inward below the horizontal joint; and means for stiffening the opposing sidewalls.

2. The steam turbine exhaust hood according to claim 1, wherein the means for stiffening the opposing sidewalls comprise a plurality of stiffening bends, adapted to at least one of reduce and eliminate internal transverse stiffeners.

3. The steam turbine exhaust hood according to claim 1, wherein the means for stiffening the opposing sidewalls comprise at least one stiffening curvature, adapted to at least one of reduce and eliminate internal transverse stiffeners.

4. The steam turbine exhaust hood according to claim 3, wherein the at least one stiffening curvature of the opposing sidewalls comprise a simple curvature.

5. The steam turbine exhaust hood according to claim 3, wherein the at least one stiffening curvature of the opposing sidewalls comprise a complex curvature.

6. The steam turbine exhaust hood according to claim 1, wherein the opposing sidewalls comprise at least one external stiffening beam, adapted to at least one of reduce and eliminate internal transverse stiffeners.

7. The steam turbine exhaust hood according to claim 1, wherein the opposing sidewalls comprise at least one stiffening bend and at least one external stiffening beam, adapted to at least one of reduce and eliminate internal transverse stiffeners.

8. The steam turbine exhaust hood according to claim 1, wherein the means for stiffening the opposing sidewalls comprise at least one stiffening curvature and at least one external stiffening beam, adapted to at least one of reduce and eliminate internal transverse stiffeners.

9. The steam turbine exhaust hood according to claim 1, wherein the means for stiffening the opposing sidewalls comprise at least at one stiffening bend and at least one external stiffening beam, adapted to at least one of reduce and eliminate internal transverse stiffeners.

10. The steam turbine exhaust hood according to claim 1, wherein the means for stiffening the opposing sidewalls comprise at least one stiffening bend, at least one stiffening curvature, and at least one external stiffening beam, adapted to at least one of reduce and eliminate internal transverse stiffeners.

11. A method for stiffening sidewalls of a lower exhaust hood of a steam turbine exhaust hood comprising:

tapering opposing sidewalls inward on a chute section below a horizontal joint of the lower hood; and providing means for stiffening the opposing sidewalls, wherein the means for stiffening are adapted to at least one of reduce and eliminate internal transverse stiffeners.

12. The method for stiffening sidewalls according to claim 11, further comprising:

forming at least one stiffening bend on the inward tapering sidewalls, wherein the at least one stiffening bends are adapted to at least one of reduce and eliminate internal transverse stiffeners.

13. The method for stiffening sidewalls according to claim 11, comprising:

forming at least one stiffening curvature on the inward tapering sidewalls, wherein the at least one stiffening bends are adapted to at least one of reduce and eliminate internal transverse stiffeners.

14. The method for stiffening sidewalls according to claim 13, wherein the stiffening curvature of the opposing sidewalls comprise a simple curvature.

15. The method for stiffening sidewalls according to claim 13, wherein the stiffening curvature of the opposing sidewalls comprise a complex curvature.

16. The method for stiffening sidewalls according to claim 13, comprising:

applying at least one external stiffening beam to the sidewalls, adapted to at least one of reduce and eliminate internal transverse stiffeners.

17. The method for stiffening sidewalls according to claim 13, comprising: forming at least one stiffening bend on the inward tapering sidewalls; and forming at least one stiffening curvature on the inward tapering sidewalls;

wherein the at least one stiffening bend and the at least one stiffening curvature are adapted to at least one of reduce and eliminate internal transverse stiffeners.

18. The method for stiffening sidewalls according to claim 13, comprising: forming at least one stiffening bend on the inward tapering sidewalls; and applying at least one external stiffening beam external to the inward tapering sidewalls;

wherein the at least one stiffening bend and the at least one external stiffening beam are adapted to at least one of reduce and eliminate internal transverse stiffeners.

19. The method for stiffening sidewalls according to claim 13, comprising:

forming at least one stiffening curvature on the inward tapering sidewalls; and applying at least one external stiffening beam to the inward tapering sidewalls;

wherein the at least one stiffening curvature and the at least one stiffening curvature are adapted to at least one of reduce and eliminate internal transverse stiffeners.

20. The method for stiffening sidewalls according to claim 13, comprising:

forming at least one stiffening bend on the inward tapering sidewalls;

forming at least one stiffening curvature on the inward tapering sidewalls; and applying at least one one external stiffening beam to the inward tapering sidewalls;

wherein the at least one stiffening bend, the at least one stiffening curvature and the at least one stiffening curvature are adapted to at least one of reduce and eliminate internal transverse stiffeners.

* * * * *